US007011059B2

(12) United States Patent
Plank et al.

(10) Patent No.: US 7,011,059 B2
(45) Date of Patent: Mar. 14, 2006

(54) CAMSHAFT ADJUSTER

(75) Inventors: Jens Plank, Berlin (DE); Peter Schmidt, Berlin (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/940,937

(22) Filed: Sep. 14, 2004

(65) Prior Publication Data

US 2005/0056245 A1 Mar. 17, 2005

Related U.S. Application Data

(63) Continuation-in-part of application No. PCT/EP03/01527, filed on Feb. 15, 2003.

(30) Foreign Application Priority Data

Mar. 15, 2002 (DE) ..... 102 11 467

(51) Int. Cl.
*F01L 1/34* (2006.01)

(52) U.S. Cl. ..... 123/90.17; 123/90.15

(58) Field of Classification Search ..... 123/90.15, 123/90.16, 90.17, 90.18
See application file for complete search history.

(56) References Cited

U.S. PATENT DOCUMENTS

| | | | | |
|---|---|---|---|---|
| 5,450,825 | A * | 9/1995 | Geyer et al. | 123/90.17 |
| 6,311,658 | B1 * | 11/2001 | Eguchi | 123/90.17 |
| 2001/0017116 | A1 | 8/2001 | Eguchi | |

FOREIGN PATENT DOCUMENTS

| | | |
|---|---|---|
| DE | 196 11 365 | 9/1997 |
| DE | 198 17 319 | 10/1999 |
| DE | 199 55 507 | 6/2001 |

* cited by examiner

*Primary Examiner*—Thomas Denion
*Assistant Examiner*—Ching Chang
(74) *Attorney, Agent, or Firm*—Klaus J. Bach

(57) ABSTRACT

In a camshaft adjuster having a 4/2-way valve which rotates with the camshaft and includes a hydraulic control valve with a hydraulic control spool or piston, which is actuated in a control cylinder against the force of a compression spring between two end stops by a magnet armature of an electromagnet which is fastened to a control casing, the electromagnet is a repelling proportional magnet, whose magnet armature is seated fixedly on an armature plunger whose free end face is in contact with the control spool or with a part fixedly connected to the latter for moving the control spool against the force of the compression spring to actuate the hydraulic control valve so as to control fluid admission to the camshaft adjuster, the working stroke of the electromagnet exceeding that of the control spool.

3 Claims, 1 Drawing Sheet

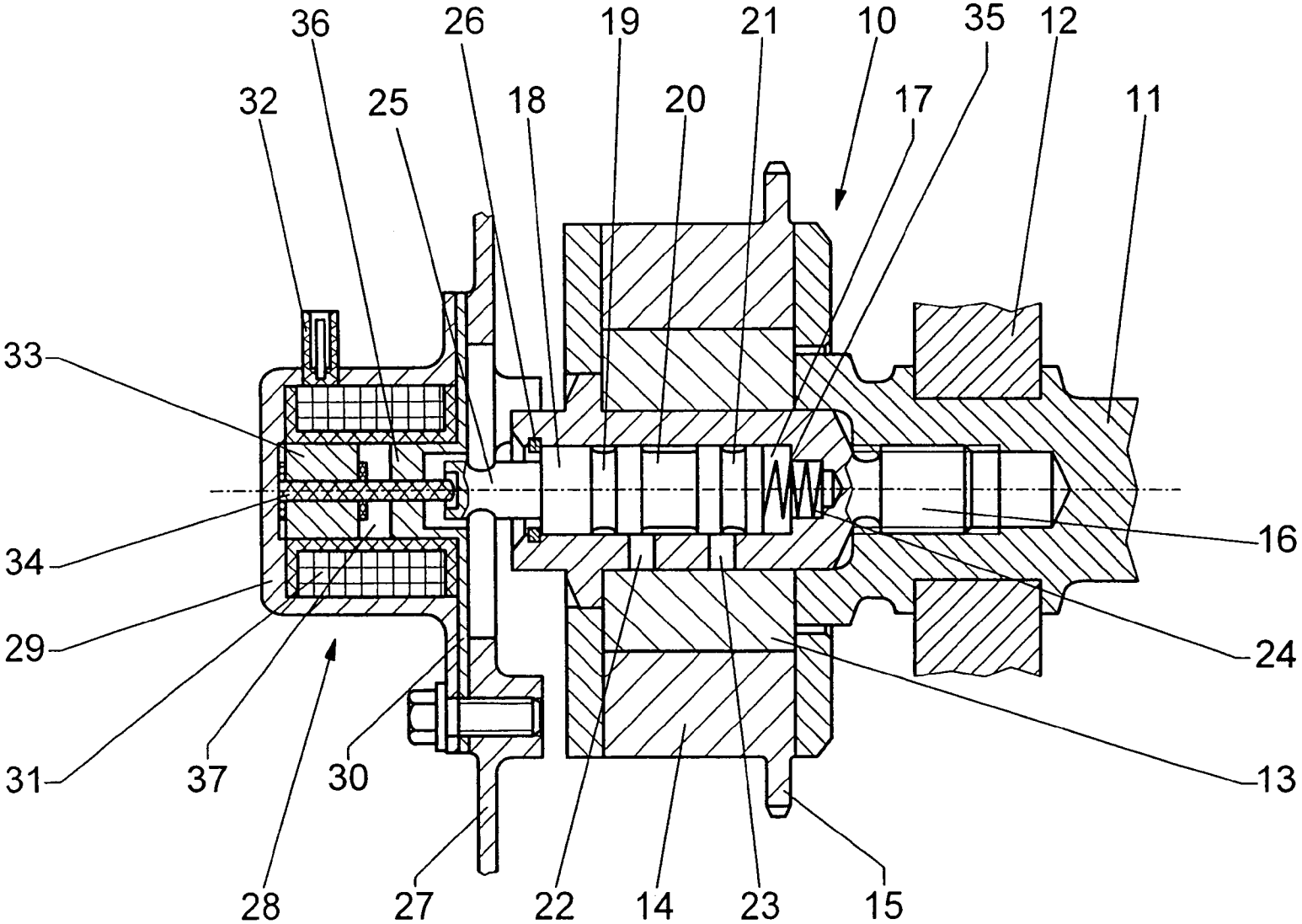
11
12
35
17
10
21
20
19
18
26
25
36
32
33
34
29
31
37
28
30
27
22
14
23
15
13
24
16

CAMSHAFT ADJUSTER

This is a Continuation-In-Part application of international application PCT/EP03/01527 filed Feb. 15, 2003 and claiming the priority of German application 102 11 467.6 filed Mar. 15, 2002.

BACKGROUND OF THE INVENTION

The invention relates to a camshaft adjuster supported for rotation with the camshaft and including a valve spool disposed in a cylinder opening for actuation therein against the force of a compression spring.

DE 196 11 365 discloses such a camshaft adjuster for an internal combustion engine, which adjuster is fastened at one end of a camshaft by means of a central clamping screw. The camshaft adjuster has an outer part which is driven via a chain sprocket and in turn drives an inner part which is connected fixedly to the camshaft for rotation therewith. The rotational angle position of the outer part relative to the inner part can be adjusted hydraulically. An electromagnetically actuated control valve is provided whose control piston is guided axially displaceably in a control cylinder for this purpose. The control cylinder is integrated in the central clamping screw. The control piston protrudes from the control cylinder with a journal. A magnet armature of an electromagnet is seated on the free end of the journal, the magnet casing of which electromagnet is screwed to a control casing cover of an internal combustion engine together with a magnet flange. Located in the magnet casing is a magnet coil having a central coil space in which the magnet armature is disposed so as to rotate with the camshaft and is axially displaceably supported therein.

For satisfactory operation of the camshaft adjuster, the electromagnet has to be oriented radially with respect to the magnet armature. During the assembly of the electromagnet, this requires the electromagnet to be properly oriented with respect to the control piston of the central clamping screw by means of a centering tool. This results in increased manufacturing complexity for the electromagnet and for the control spool. Furthermore, problems occur in the case of automated electromagnet assembly.

In order to compensate for diverse tolerances, a relatively large air gap has to be provided between the magnet armature and the electromagnet because of the arrangement of the magnet armature with respect to the central clamping screw. The air gap leads to relatively low efficiency of the magnet, which has a negative effect on the response behavior of the control valve, in particular at low oil temperatures, and therefore also on the operation of the camshaft adjuster.

It is not possible to test the valve drive as a complete unit as a result of the division of the magnet armature and the electromagnet into two components, which leads to increased manufacturing complexity during production of the electromagnet and magnet armature.

Moreover, DE 199 55 507 A1 discloses a camshaft adjuster in which the central clamping screw is integrally formed on the end of the camshaft. A nut is screwed onto a threaded part at the end of the clamping screw, the camshaft adjuster being held on the camshaft by said nut. The integrally formed clamping screw, in which a control cylinder of a 4/2-way valve is integrated, can be machined together with the camshaft, with the result that it is possible to comply more easily with manufacturing tolerances between the camshaft, the clamping screw and the control cylinder. Manufacturing is nevertheless complicated, as the camshaft with the integrally formed clamping screw is a complex component and the size of the gap between the control cylinder and the control piston is to be kept as small as possible with regard to the efficiency of the electromagnet. Furthermore, it is presumed that the camshaft has satisfactory roundness and the magnet armature and the electromagnet are accurately centered.

It is therefore the object of the invention to provide an improved the electromagnet assembly using simple means and to improve the response behavior of the control valve and therefore also the functioning of the camshaft adjuster.

SUMMARY OF THE INVENTION

In a camshaft adjuster having a 4/2-way valve which rotates with the camshaft and includes a hydraulic control valve with a hydraulic control spool or piston, which is actuated in a control cylinder against the force of a compression spring between two end stops by a magnet armature of an electromagnet which is fastened to a control casing, the electromagnet is a repelling proportional magnet, whose magnet armature is seated fixedly on an armature plunger whose free end face is in contact with the control spool or with a part fixedly connected to the latter for moving the control spool against the force of the compression spring to actuate the hydraulic control valve so as to control fluid admission to the camshaft adjuster, the working stroke of the electromagnet exceeding that of the control spool.

Preferably, the magnet armature is seated fixedly on an armature plunger whose free end face is in loose contact with the control piston or spool or with a part fixedly connected to the latter. The functioning of the electromagnet can be tested independently of the 4/2-way valve, for example before assembly. The design according to the invention achieves the situation where no constraining forces occur between the magnet armature and the control piston as a result of manufacture or assembly errors, so that minimum frictional losses occur in all operational ranges, even at extremely variable temperatures. Furthermore, the size of the gap between the control cylinder and the control piston has no effect on the air gap between the magnet armature and the magnet coil, so that small air gaps can be realized with low manufacturing complexity. As a result of these measures, the full performance of the repelling magnet is available for the adjusting movement of the control piston, whereby a rapid response behavior of the control valve and therefore also of the camshaft adjuster is achieved even at low temperatures of approximately −20° C. An unbalance or unsatisfactory roundness of the magnet armature no longer plays a decisive role as a result of the decoupling of the magnet armature from the rotating camshaft, the rotation not being transmitted, or at least not to a significant degree, via the contact faces between the armature plunger and the journal of the control piston.

In order for it to be more readily possible to compensate for angular offset between the longitudinal axis of the magnet armature and of the armature plunger on one side and the longitudinal axis of the control spool on the other side, it is expedient if at least one of the contact faces between the armature plunger on one side and the control piston or the journal on the other side is of convex design. At the same time, the contact faces are reduced as a result, so that torque transmission by slip is scarcely possible.

The electromagnet is configured as a proportional magnet with a pole core which, in particular, conducts the magnetic flux and through which the armature plunger is guided. If a current signal is applied to the magnet coil of the electromagnet, the armature plunger comes into contact with the journal of the control piston and displaces the latter, in accordance with the current intensity, counter to the force of the compression spring which acts on the control piston from the opposite side. The magnet armature and the armature plunger can be expediently guided in an axially displaceable manner in the inner coil space of the magnet coil and/or in the cup-shaped part of the magnet flange. Furthermore, the electromagnet can be activated in such a way that the control piston does not occupy any intermediate positions but occupies one end position when current is applied to the electromagnet and is moved by the compression spring to the other end position when the electromagnet is de-energized. In order to obtain a sufficient degree of freedom for the axial orientation of the electromagnet, the latter has a working stroke exceeding the working stroke of the control piston.

Further advantages will become apparent from the following description of an exemplary embodiment of the invention on the basis of the accompanying drawing. The description and the claims contain numerous features in combination.

BRIEF DESCRIPTION OF THE DRAWING

The sole FIGURE of the drawing shows a diagrammatic partial longitudinal section through a camshaft adjuster according to the invention.

DESCRIPTION OF PREFERRED EMBODIMENTS

A camshaft 11 is rotatably mounted in a casing wall 12 of an internal combustion engine (not shown). A camshaft adjuster 10 is fastened to the end of the camshaft 11 by means of a central clamping screw 16 which is screwed into the camshaft 11. The camshaft adjuster 10 has an inner part 13 and an outer part 14, the inner part 13 being connected fixedly to the camshaft 11 so as to rotate with it, while the outer part 14 has a chain sprocket 15 for driving purposes. The inner part 13 can be displaced hydraulically by a rotational angle relative to the outer part 14. A hydraulic displacing mechanism (not shown in detail) can be configured in the manner as described for example in DE 196 54 926 C2 or DE 198 17 319 A1.

A hydraulic pressure medium is fed to the hydraulic adjusting mechanism via a 4/2-way control valve, whose control piston 18 is arranged axially displaceably in a control cylinder 17 which is integrated in the clamping screw 16. The control cylinder 17 has control passages 22, 23 which are controlled by the control piston 18 and via which the pressure medium is conducted to and from the hydraulic adjusting mechanism. The control piston 18 has control grooves 19, 20 and 21 for control purposes, via which control grooves the control passages 22, 23 are connected to pressure lines or fluid relief channels (not shown) depending on the position of the control piston 18. The end positions of the control piston 18 are determined by axial stops 26 in the control cylinder 17.

At its end facing the camshaft 11, the control piston 18 is loaded by a compression spring 24 which biases the control piston with a defined prestress against an end stop 26 in the control cylinder 17. At its opposite end, the control piston 18 has a journal 25 which is integrally formed on the control piston 18 and protrudes slightly out of the control cylinder 17. A repelling proportional magnet, what is referred to as a repelling magnet 28, actuates the control piston 18. It has an armature plunger 34 to which a magnet armature 33 is fastened and is guided axially displaceably in a coil space 37 of a magnet coil 31. When current is applied to the magnet coil 31 via an electrical connection 32, the magnet armature 33 is moved in the magnetic field of the magnet coil 31 toward a cup-shaped pole core 36 of a magnet flange 30. Here, the end of the armature plunger 34 comes into contact with the journal 25 of the control piston 18 and displaces the latter, in accordance with the current supply to the magnet coil 31, counter to the force of the compression spring 24 as far as at most an end stop 35.

Furthermore, it can be expedient for at least one of the contact faces between the armature plunger 34 and the journal 25 to be of convex design, with the result that no tilting moments are produced and rotational movements are transmitted at the contact point in the event of an angular deviation between the longitudinal axis of the armature plunger 34 and that of the control piston 18 at the contact point. As a result of the loose connection between the armature plunger 34 and the journal 25, the friction between the control piston 18 and the control cylinder 17 and between the magnet armature 33 and the armature plunger 34 and the associated guides is minimized, with the result that the response behavior of the control valve is optimal and permits displacement of the camshaft 11 even at low temperatures. The magnet casing 29 and the magnet flange 30 are screwed to a control casing cover 27 and sealed by means of a flat sealing means.

What is claimed is:

1. A camshaft adjuster for adjusting the relative angular positions of a camshaft drive and a camshaft (11) of an internal combustion engine, said camshaft adjuster comprising a 4/2 way valve (17, 18) mounted co-axially on the camshaft (11) for rotation therewith and including a hydraulic control piston (18) movably disposed in a control cylinder (17) so as to be movable between two end stops (26, 35) in the control cylinder (17), a compression spring (24) disposed in the control cylinder so as to bias the control piston toward the end stop (26) remote from the camshaft (11), a control casing (29) disposed axially adjacent the control piston (18) opposite the camshaft (11), an electromagnet (28) in the form of a repelling proportional magnet disposed in the control casing (29) and having an armature plunger (34) with a magnet armature (33) for actuating the plunger (34) for engaging the control piston (18) and moving it against the force of the compression spring (24), the armature plunger (34) of the electromagnet (28) having an operating stroke exceeding that of the control piston (18).

2. A camshaft adjuster as claimed in claim 1, wherein the armature plunger (34) is in contact with an end face of a journal (25) which is integrally formed on the control piston (18) and protrudes out of a control cylinder (17).

3. A camshaft adjuster as claimed in claim 1, wherein at least one of the contact faces between the armature plunger (34) on one side and the control piston (18) or journal (25) on the other side has a convex end face.

* * * * *